US008487835B2

(12) United States Patent
Jung

(10) Patent No.: US 8,487,835 B2
(45) Date of Patent: Jul. 16, 2013

(54) DISPLAY DEVICE

(76) Inventor: Sukho Jung, Seongnam-si (KR)

( * ) Notice: Subject to any disclaimer, the term of this patent is extended or adjusted under 35 U.S.C. 154(b) by 409 days.

(21) Appl. No.: 12/767,924

(22) Filed: Apr. 27, 2010

(65) Prior Publication Data

US 2011/0260950 A1 Oct. 27, 2011

(51) Int. Cl.
*G09G 5/00* (2006.01)

(52) U.S. Cl.
USPC ..... 345/4; 345/1.1; 345/5

(58) Field of Classification Search
USPC ..... 345/1.1, 3.1, 4, 5
See application file for complete search history.

(56) References Cited

U.S. PATENT DOCUMENTS

| | | | | |
|---|---|---|---|---|
| 3,703,329 | A | 11/1972 | Castellano | |
| 4,547,043 | A | 10/1985 | Penz | |
| 5,184,234 | A | 2/1993 | Mathewson | |
| RE36,654 | E | 4/2000 | Conner et al. | |
| 7,580,097 | B2 * | 8/2009 | Moon et al. | 349/113 |
| 2003/0060271 | A1 | 3/2003 | Gilmore et al. | |
| 2004/0027518 | A1 * | 2/2004 | Kato et al. | 349/113 |
| 2006/0290594 | A1 * | 12/2006 | Engel et al. | 345/4 |
| 2007/0242028 | A1 | 10/2007 | Kitagawa et al. | |
| 2008/0007486 | A1 * | 1/2008 | Fujinawa et al. | 345/5 |
| 2008/0088649 | A1 * | 4/2008 | Ikeno et al. | 345/690 |
| 2008/0309811 | A1 * | 12/2008 | Fujinawa et al. | 348/333.01 |
| 2009/0027598 | A1 | 1/2009 | Ikeno et al. | |
| 2009/0121985 | A1 | 5/2009 | Kang et al. | |

FOREIGN PATENT DOCUMENTS

| | | |
|---|---|---|
| JP | 2008-191287 | 8/2008 |
| KR | 20110064881 | 6/2011 |

OTHER PUBLICATIONS

International Search Report for International Patent Application No. PCT/KR2010/008975 mailed Feb. 14, 2011.

Phanindra Narayan Gundu et al "High efficient superresolution combination filter with twin LCD spatial light modulators" Optics Express, vol. 13, No. 8, Apr. 18, 2005, pp. 2835-2842.

* cited by examiner

*Primary Examiner* — Jason Mandeville
(74) *Attorney, Agent, or Firm* — Workman Nydegger

(57) ABSTRACT

A display device is provided. A display device includes a first display panel and a second display panel disposed on the first display. One of the first display panel and the second display panel is monochrome and the other of the first display panel and the second display panel is color.

14 Claims, 8 Drawing Sheets

DISPLAY DEVICE

BACKGROUND

Display devices of high resolution, such as a plasma display panel (PDP) and a liquid crystal display (LCD) display high resolution images, e.g., full high definition (HD) images of 1920 by 1080 pixels. An interest for high-resolution display panels in a fairly large size has been increased. However, a manufacturing cost generally increases, as a size of a display panel is larger.

DETAILED DESCRIPTION

Figure 1:
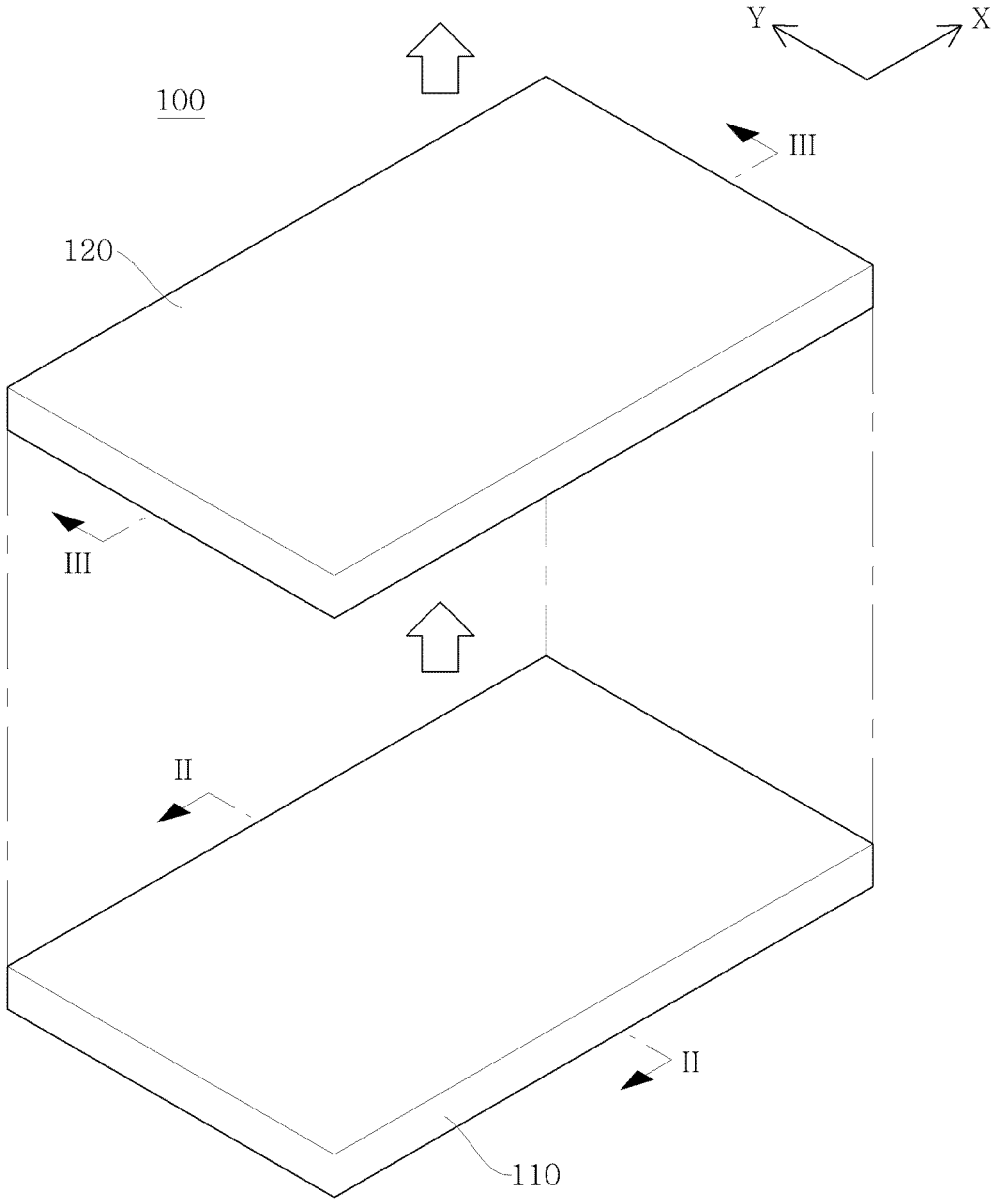
FIG. 1 is a schematic diagram showing an illustrative embodiment of a display device.

In one embodiment, a display device includes a first display panel and a second display panel. First display panel is configured to generate a first image, and second display panel is disposed on the first display panel and configured to generate a second image using light from the first display panel. One of first display panel and second display panel has monochrome and the other of first display panel and second display panel has color.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

In the drawings, the thickness of layers, films, panels, regions, etc., are exaggerated for clarity. Like reference numerals designate like elements throughout the specification. It will be understood that when an element such as a layer, film, region, panel, or substrate is referred to as being "on" another element, it can be directly on the other element or intervening elements may also be present. In contrast, when an element is referred to as being "directly on" another element, there are no intervening elements present.

FIG. 1 illustrates that a display device 100 includes a first display panel 110 and a second display panel 120. First and second display panels 110 and 120 may be a flat display panel respectively, but not limited thereto, and for example may be a curved display panel.

First and second display panels 110 and 120 may be coupled together in a frame, a case, and so on (not shown). By way of example, FIG. 1 illustrates that first and second display panels 110 and 120 are included in a frame (not shown) to be apart from each other. By way of another example, first and second display panels 110 and 120 may be disposed to contact each other in the frame or they may be closely disposed in the frame. In some embodiments, an optical film or layer may be interposed between first and second display panels 110 and 120 to enhance optical characteristics of display device 100.

First and second display panels 110 and 120 are disposed to overlap with each other such that viewing areas thereof overlap with each other. Here, the viewing area refers an area where images are displayed and the viewing area is composed of pixels. The overlapping of the pixels in the viewing areas will be described in detail hereinafter.

First display panel 110 is configured to generate a first image, and second display panel 120 is configured to generate a second image using light emitted from first display panel 110. In one embodiment, first display panel 110 may be a self-emissive display panel, such as a plasma display panel (PDP), an organic light emitting display (OLED) panel, a field emission display (FED) panel, a cathode ray tube (CRT) panel, a vacuum fluorescent display (VFD) panel, and so on. Second display panel 120 may be a non-emissive display panel, such as a liquid crystal display (LCD) panel, and so on, but not limited thereto. In this case, first display panel 110 may emit light, and the light emitted from first display panel 110 can pass through second display panel 120.

In another embodiment, first display panel 110 may be a non-emissive display panel with a backlight unit (not shown), and second display panel may be the non-emissive display panel. For example, first display panel 110 may be an LCD panel having a backlight unit therebelow, and second display panel 120 may be an LCD panel without a backlight unit. In this case, light can be emitted from the backlight unit, and the light can pass through first and second display panels 110 and 120 sequentially. Thus, first and second display panels 110 and 120 can generate images using the light from the backlight unit, respectively. In either embodiment, light can sequentially pass through first and second display panels 110 and 120, as indicated by arrows shown in FIG. 1.

One of first and second display panels 110 and 120 is monochrome and the other of first and second display panels 110 120 is color. For example, one of first and second display panels 110 and 120 may be black-and-white and the other of first and second display panels 110 and 120 may be color with three primary colors, such as red, green, and blue.

In one embodiment, one of first and second display panels 110 and 120 may include a first pixel with primary color subpixels, e.g., a red subpixel, a green subpixel, and a blue subpixel and the other of first and second display panels 110 and 120 may include a second pixel with a plurality of white subpixels. Here, a pixel is defined as a set of subpixels and is a basic unit representing a color.

First pixel and second pixel are configured and arranged with each other such that each of the red subpixel, the green subpixel, and the blue subpixel overlaps at least partially with each of white subpixels of second pixel.

Figure 2:
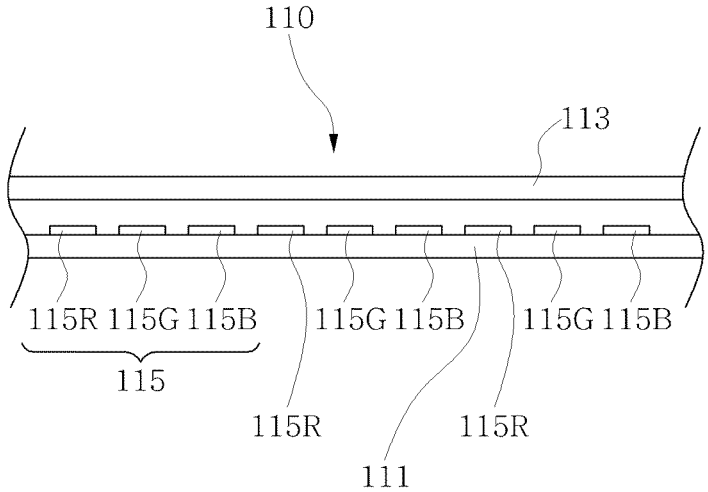
FIG. 2 is a cross sectional view taken along a line II-II in FIG. 1.
Figure 3:
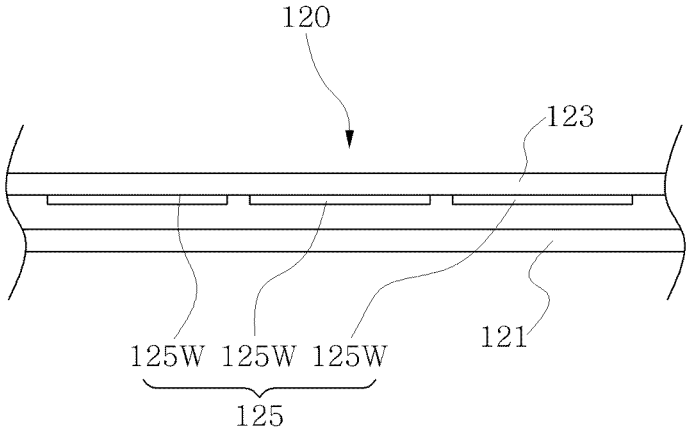
FIG. 3 is a cross sectional view taken along a line III-III in FIG. 1.

FIG. 2 and FIG. 3 are cross sectional views taken along lines II-II and III-III in FIG. 1, respectively. For the purpose of the descriptions, in FIG. 2 and FIG. 3, first display panel is illustrated as a PDP and second display panel 120 is illustrated as an LCD panel. Also, for the simplicity of the description, only substrates and subpixels are shown, and other elements of a PDP and an LCD panel are omitted.

Referring to FIG. 2, first display panel (e.g., PDP) 110 includes a first pixel 115 having primary color subpixels, e.g., a red subpixel 115R, a green subpixel 115G and a blue subpixel 115B. First display panel 110 may include a first substrate 111 and a second substrate 113, and substrates 111 and 113 may be made of insulating transparent material, such as transparent glass or plastic, but not limited thereto.

Primary color subpixels 115R, 115G and 115B may be formed on first substrate 111, but not limited thereto. In more detail, first display panel 110, e.g., a PDP panel, may include barrier ribs formed on first substrate 111, address electrodes, bus electrodes, transparent electrodes, a dielectric layer, and so on, and subpixels 115R, 115G, and 115B may be formed on first substrate 111 by forming phosphors layers of corresponding colors between the barrier ribs. By way of example, a plurality of address electrodes covered with an insulation layer may be formed on first substrate 111. Barrier ribs may be formed in parallel with the address electrodes on the insulation layer disposed between the address electrodes, and phosphor may be formed on the surface of the insulation layer between the barrier ribs. Transparent electrodes and bus electrodes may be sequentially formed on the bottom of second substrate 113, and a dielectric layer may be formed to cover the bus electrodes and the transparent electrodes. First and second substrates 111 and 113 may be faced each other to form a plasma discharge space therebetween and to make the transparent electrodes and the bus electrodes respectively cross the address electrode.

Red subpixel 115R, green subpixel 115G and blue subpixel 115B represent red color, green color, and blue color, respectively, and form first pixel 115 which is a basic unit representing a color. Thus, first pixel 115 can have a color that is formed by sum of three subpixels 115R, 115G and 115B.

In another illustrative embodiment, an organic light emitting display (OLED) panel may be used as a first display panel, instead of a PDP. OLED panel may include a substrate, a first electrode (e.g., anode) disposed on the substrate, an emission layer which includes an organic material and is disposed on the first electrode, and a second electrode (e.g., cathode) disposed on the emission layer. The substrate may be made of transparent material, such as glass. The first and second electrodes may be made of transparent material, translucent material, or reflective material, depending on a type of OLED. For example, the transparent material may be indium-tin oxide (ITO) or indium-zinc oxide (IZO). In this case, primary color subpixels may be formed by forming color filters on the emission layer or on the first electrode. The color filters, e.g., the red color filter, the green color filter, and the blue color filter may be formed by applying a color (R, G, or B) photoresist (PR) including color (R, G, or B) pigment on the emission layer or on the first electrode by spin coating or roll coating, then exposing the color PR to light, developing the exposed color PR by using a mask having a desired pattern, and baking.

In yet another illustrative embodiment, a liquid crystal display (LCD) panel may be used as first display panel, instead of a PDP. The LCD panel may include a first substrate (e.g., TFT array substrate), a second substrate (e.g., color filter substrate), a liquid crystal layer interposed between the first and second substrates, a polarizer, and so on. Primary color subpixels may be formed by forming color filters on a bottom of the color filter substrate. The color filters may be formed by the same method of forming the color filter of OLED.

Referring to FIG. 3, second display panel (e.g., LCD panel) 120 includes a plurality of white subpixels 125W. White subpixels 125W represent transparent white color, respectively. Although FIG. 3 illustrates that three white subpixels 125W forms a second pixel 125, it is apparent to those skilled in the art that second pixel 125 may also be formed by two or more than three white subpixels 125W. Second display panel 120 may include a first substrate (e.g., TFT array substrate) 121 and a second substrate (e.g., color filter substrate) 123, and substrates 121 and 123 may be made of insulating transparent material, such as transparent glass or plastic, but not limited thereto.

White subpixels 125W may be formed on a bottom of second substrate 123, but not limited thereto. In more detail, second display panel 120, e.g., an LCD panel, may include a thin film transistor (TFT) layer, a liquid crystal layer, electrodes, and so on. For example, display signal lines, such as gate lines and data lines, may be formed on first substrate 121. The TFT layer including a transmissive capacitor, a storage capacitor, and the like may also be formed on first substrate 121, and these capacitors may include a transmissive electrode, a reflective electrode, a storage electrode, and the like. A common electrode and a color filter may be formed on the bottom of second substrate 123. First and second substrate 121 and 123 may be disposed to face each other and a liquid crystal layer may be interposed therebetween.

White subpixels 125W may be formed on, e.g., the bottom of second substrate 123, by forming transparent color filters on corresponding areas or may be formed without forming a color filter on corresponding areas. The transparent color filter of white subpixel 125W may be made of a photoresist (PR) without pigments.

Figure 4:
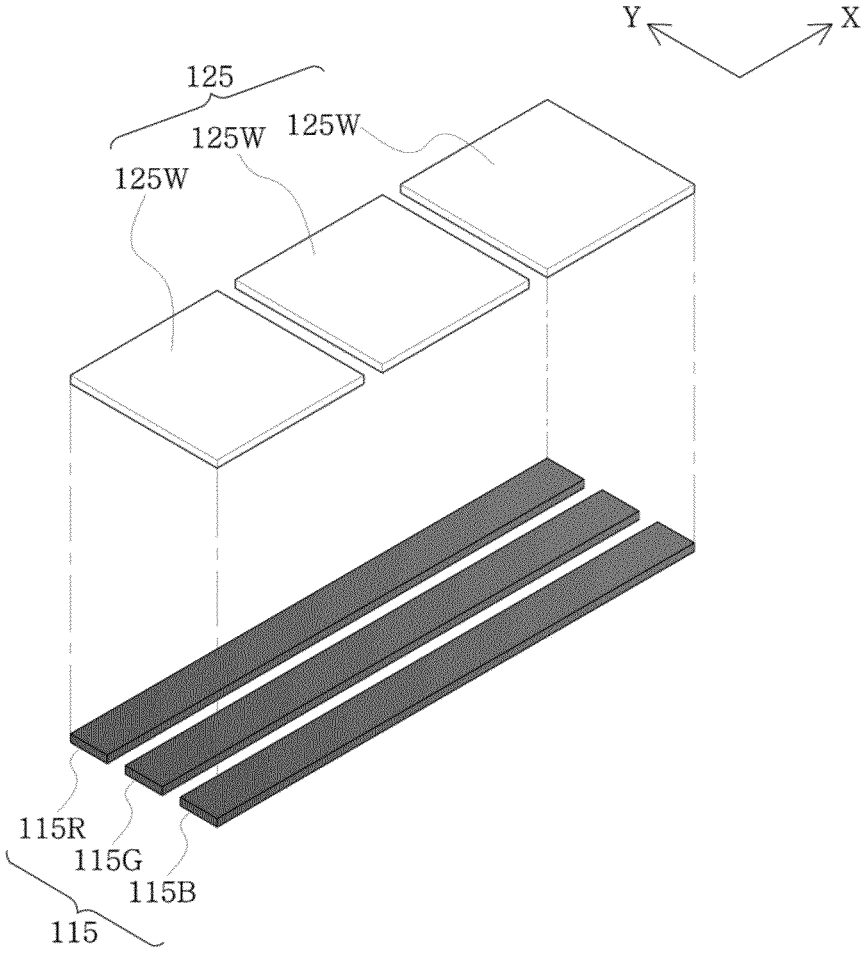
FIG. 4 is a schematic diagram showing subpixels of the display device shown in FIG. 1.
Figure 5:
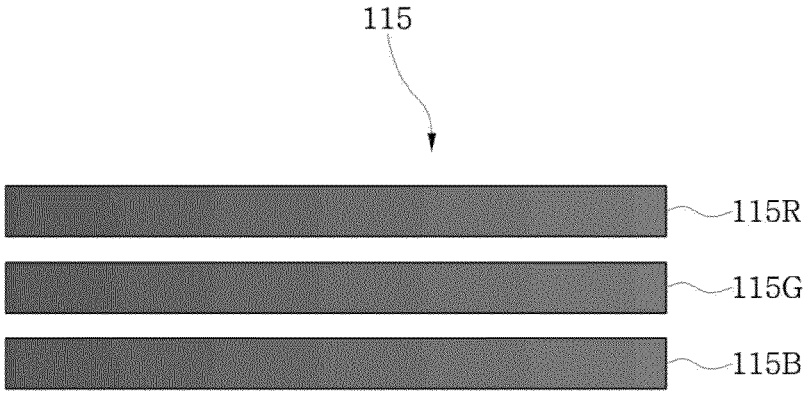
FIG. 5 and FIG. 6 show primary color subpixels and white subpixels of the display device shown in FIG. 1.
Figure 6:
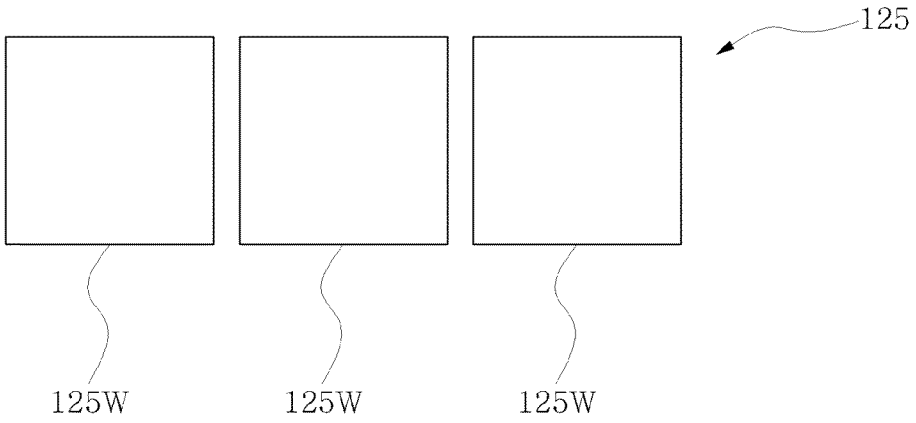
Figure 7:
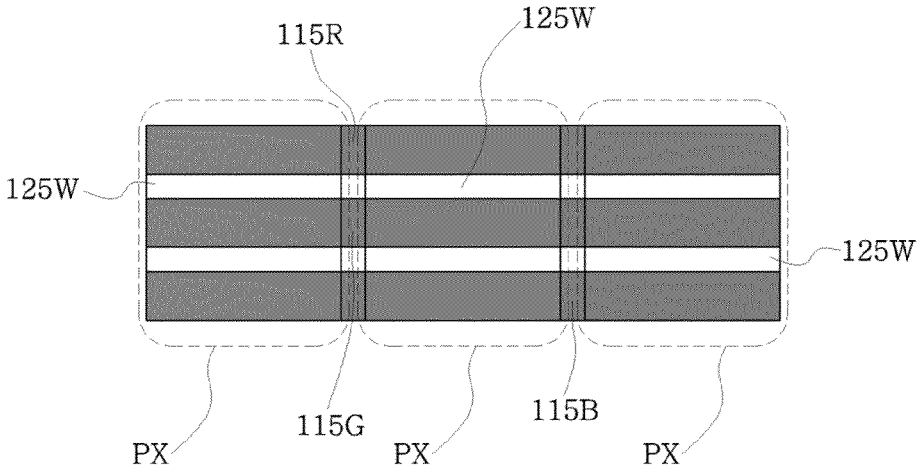
FIG. 7 is a schematic diagram showing a third pixel formed by overlapping of primary color subpixels and white subpixels of the display device shown in FIG. 1.

Configuration and arrangement of subpixels of a display device according to an illustrative embodiment is described with reference to FIG. 4 to FIG. 7. FIG. 4 is a schematic diagram showing the subpixels of the display device shown in FIG. 1. FIG. 5 and FIG. 6 show the primary color subpixels and the white subpixels of the display device shown in FIG. 1, respectively. FIG. 7 is a schematic diagram showing a third pixel formed by overlapping of the primary color subpixels and the white subpixels of the display device shown in FIG. 1.

FIG. 4 illustrates that red, green and blue subpixels 115R, 115G and 115B of first display panel 110 are arranged in the same plane along a Y-axis, and white subpixels 125W of second display panel 120 are disposed over primary color subpixels 115R, 115G and 115B and arranged along an X-axis. Although FIG. 4 to FIG. 7 illustrate that primary color subpixels 115R, 115G and 115B and white subpixels 125W are arranged in a stripe shape, it is apparent to those skilled in the art that primary color subpixels 115R, 115G and 115B and white subpixels 125W may be arranged in various shapes, such as a stripe shape and a matrix shape. The size of each of primary color subpixels 115R, 115G and 115B may be equal to or different from each other, and an order of primary color subpixels 115R, 115G and 115B may also be varied. Furthermore, the size of white subpixels 125W may be equal to or different from each other.

First pixel 115 of first display panel 110 and second pixel 125 of second display panel 120 can be configured and arranged such that each of primary color subpixels 115R, 115G and 115B overlaps at least partially with each of white subpixels 125W. By way of example, FIG. 7 illustrates that each of white subpixels 125W of second display panel 120 overlaps at least partially with a portion of each of primary color subpixels 115R, 115G and 115B, and accordingly three third pixels PX are formed. Here, third pixel PX refers to a unit pixel for representing color of display device 100, and, as illustrated in FIG. 7, each pixel PX includes a first overlapped portion of a portion of subpixel 115R and one white subpixel 125W, a second overlapped portion of a portion of subpixel 115G and the same white subpixel, and a third overlapped portion of a portion of subpixel 115B and the same white subpixel. Three first overlapped portions, which are portions of red subpixel 115R, represent the same red color respectively, three second overlapped portions, which are portions of green subpixel 115G, represent the same green color respectively, and three third overlapped portions, which are portions of blue subpixel 115B, represent the same blue color respectively. Accordingly, three third pixels PX include the same combination of three primary colors respectively, and, thus, a color of each third pixel PX, which results from the sum of primary colors represented by color subpixels thereof, becomes substantially the same. However, each third pixel PX includes independent white subpixels 125W which may be independently controlled to represent different brightness. Not shown in the drawing, each subpixel may have a control element, such as a switching TFT, and can be independently controlled to represent different color or brightness by operation of the control elements. Thus, each third pixel PX, which is formed by overlapping primary color subpixels 115R, 115G and 115B with independent white subpixel 125W, can represent the color represented by the sum of colors of three primary color subpixels 115R, 115G and 115B of first display panel 110, but the represented color may have different brightness for each third pixel PX due to the independently controlled white subpixel 125W, as described. Accordingly, three pixels PX are formed by six subpixels, i.e., three subpixels 115R, 115G and 115B and three white subpixels 125W.

Referring to FIG. 7 again, three pixels PX can be formed using six subpixels, i.e., three primary color subpixels 115R, 115G and 115B and three white subpixels 125W. Since pixel PX can be formed by overlapping of subpixels (e.g., the overlapping of color subpixels and white subpixels), the number of color subpixels for forming three pixels PX can be reduced by three. Although not shown in the drawing, two pixels PX may be formed by overlapping three primary color subpixels and two white subpixels. In addition, an increased number of pixels PX can be formed in a given area, without reducing the size of subpixels. Thus, the number of pixels may be reduced or the size of the color subpixel may be reduced if the pixel is formed by arranging the color subpixels in parallel or in serial without overlapping the color subpixels. For example, if three pixels PX are formed in the same area as illustrated in FIG. 7 by arranging the three primary colors in parallel, the respective color subpixels may be reduced to one third of the size of the color subpixels shown in FIG. 7.

Figure 8:
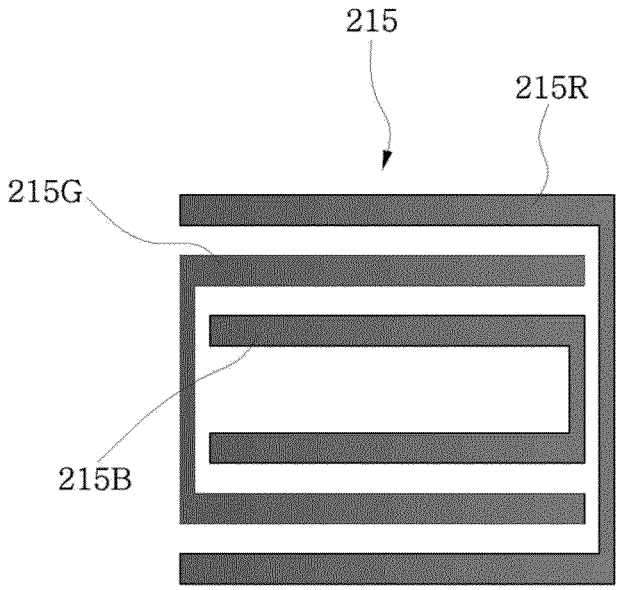
FIG. 8 and FIG. 9 show primary color subpixels and white subpixels of a display device according to another illustrative embodiment, respectively.
Figure 9:
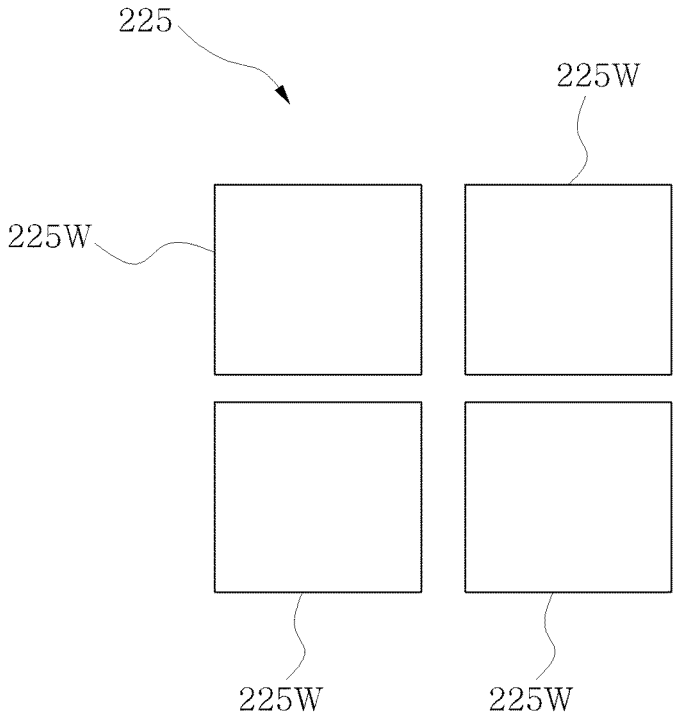
Figure 10:
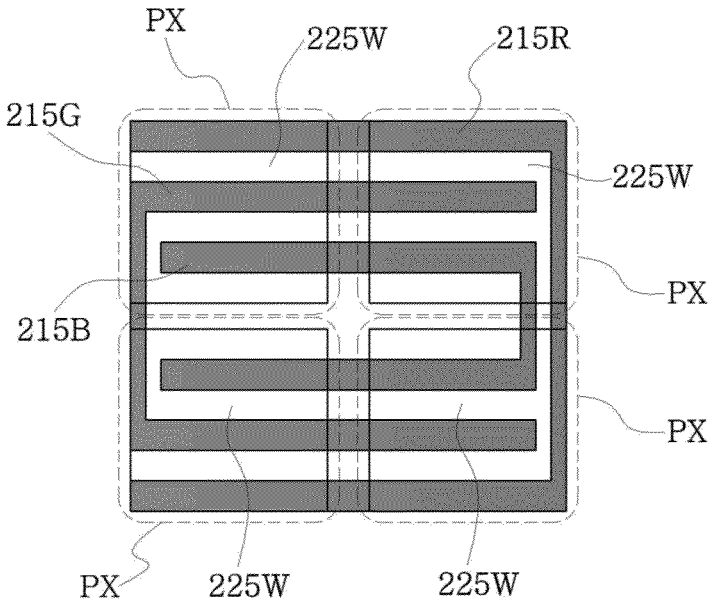
FIG. 10 is a schematic diagram showing a pixel formed by overlapping of the primary color subpixels and the white subpixels shown in FIGS. 8 and 9.

Configuration and arrangement of subpixels of a display device according to another illustrative embodiment is described with reference to FIG. 8 to FIG. 10. FIG. 8 and FIG. 9 show primary color subpixels and white subpixels of a display device according to another illustrative embodiment, respectively. FIG. 10 is a schematic diagram showing a pixel formed by overlapping of the primary color subpixels and the white subpixels shown in FIGS. 8 and 9.

FIG. 8 illustrates that a first pixel 215 includes primary color subpixels, e.g., a red subpixel 215R, a green subpixel 215G and a blue subpixel 215B. The primary color subpixels can have various shapes and they can be arranged in various ways with respect to each other. By way of example, FIG. 8 illustrates that primary color subpixels 215R, 215G and 215B have two facing surfaces and one surface connecting the facing surfaces, respectively. FIG. 8 further illustrates that each primary color subpixel has a different distance between the facing surfaces and each surface of each primary color subpixel has a different length. FIG. 8 still further illustrates that primary color subpixels 215R, 215G and 215B are arranged such that the facing surfaces of the primary color subpixels are alternatively arranged. FIG. 9 illustrates that a second pixel 225 includes four white subpixels 225W arranged in a 2 by 2 matrix. FIG. 10 illustrates primary color subpixels 215R, 215G and 215B are arranged such that each of primary color subpixels 215R, 215G and 215B overlaps at least partially with each of white subpixels 225W.

In one embodiment, each of primary color subpixels 215R, 215G and 215B can be configured to have portions disposed to be overlapped with each of four white subpixels 225W. Accordingly, portions of all of three primary color subpixels 215R, 215G and 215B can be disposed under (or over) each of white subpixels 225W. Accordingly, four pixels PX, which are arranged in a matrix shape of 2 by 2, can be formed. Here, the number of pixels PX to be formed may be determined based on the number of white subpixels.

The shapes of primary color subpixels 215R, 215G and 215B can be varied as long as each of primary color subpixels 215R, 215G and 215B can overlap at least partially with each of white subpixels 225W. In another embodiment, one or two of primary color subpixels shown in FIG. 8 may be configured to rotate with respect to the other primary color subpixels. By way of example, red subpixel 215R may be rotated in clockwise/counterclockwise direction by, for example, 90 degrees (or 180 or 270 degrees) with respect to green subpixel 215G and/or blue subpixel 215B, such that at least a portion of red subpixel 215R can be overlapped with each of white subpixels 225W. In still another embodiment, primary color subpixels 215R, 215G and 215B may have shapes of circular or rectangular rings having different sizes. Three primary color subpixels having such ring shapes may be arranged concentrically.

Figure 11:
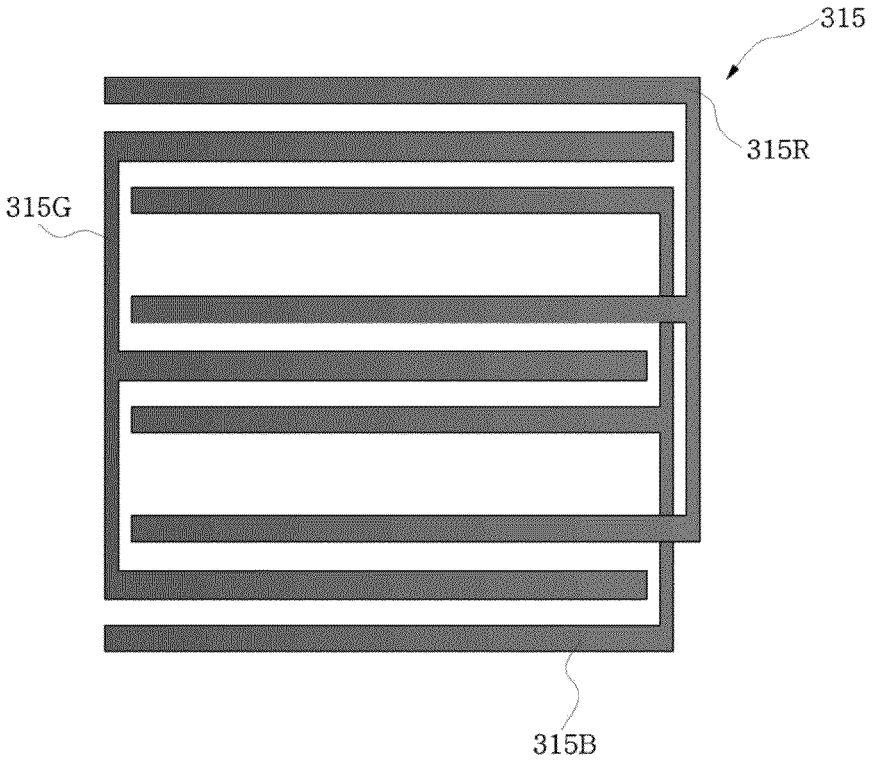
FIG. 11 and FIG. 12 show primary color subpixels and white subpixels of a display device according to yet another illustrative embodiment, respectively.
Figure 12:
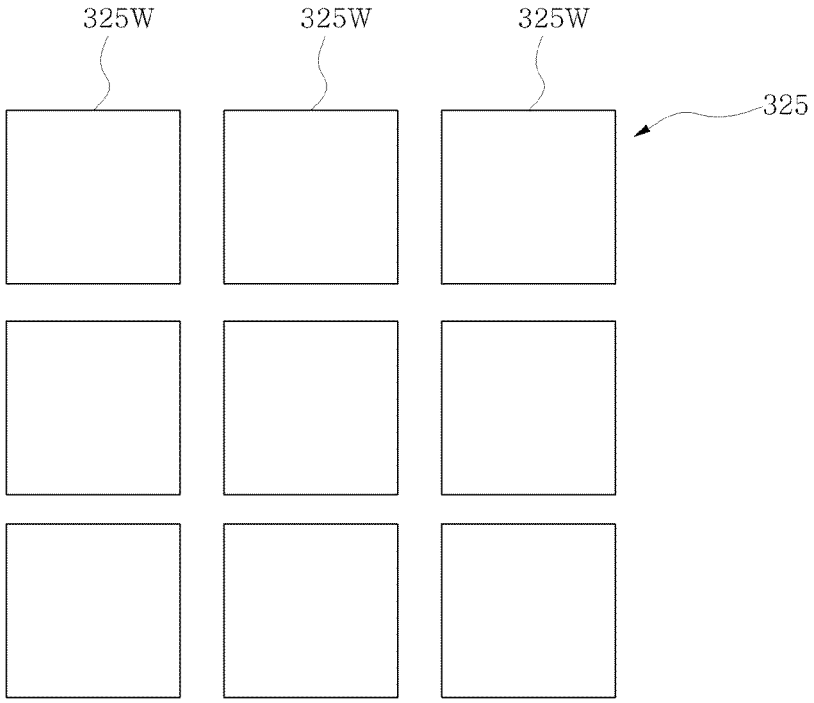
Figure 13:
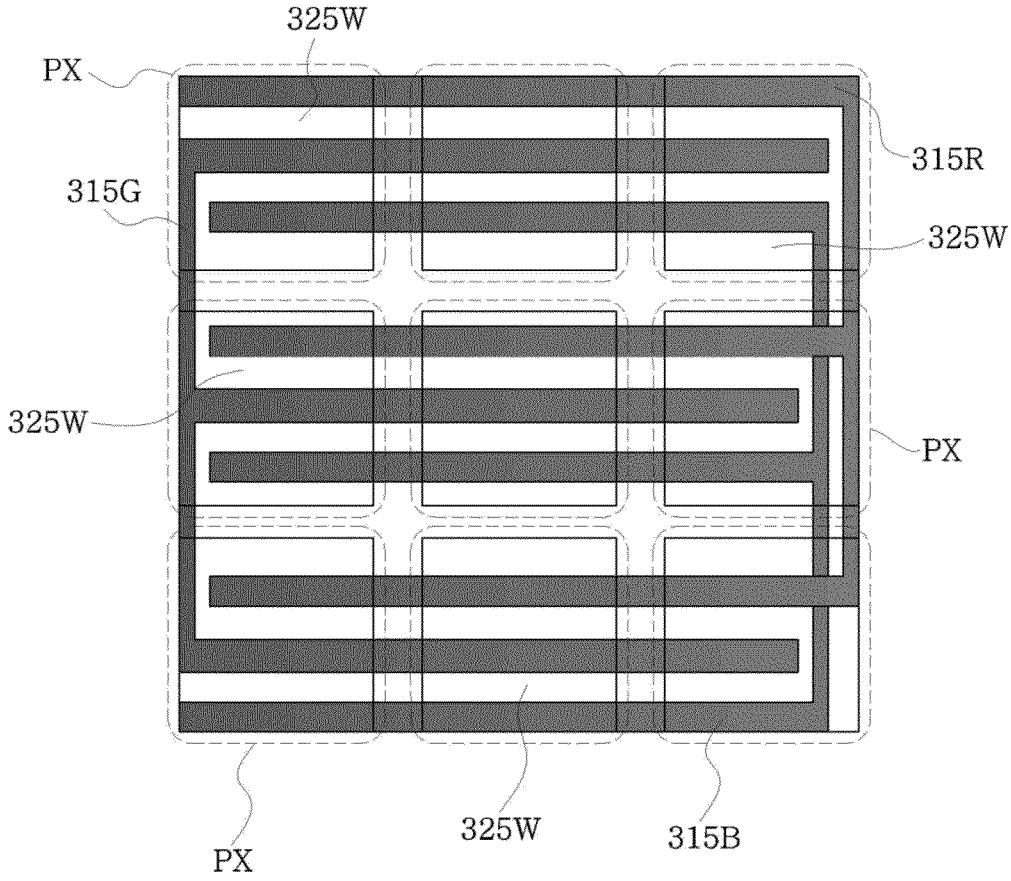
FIG. 13 is a schematic diagram showing a pixel formed by overlapping of the primary color subpixels and the white subpixels shown in FIGS. 11 and 12, respectively.

Configuration and arrangement of subpixels of a display device according to yet another illustrative embodiment is described with reference to FIG. 11 to FIG. 13. FIG. 11 and FIG. 12 show primary color subpixels and white subpixels of a display device according to yet another illustrative embodiment, respectively. FIG. 13 is a schematic diagram showing a pixel formed by overlapping of the primary color subpixels and the white subpixels shown in FIGS. 11 and 12, respectively.

FIG. 11 illustrates that a first pixel 315 includes three primary color subpixels, e.g., a red subpixel 315R, a green subpixel 315G and a blue subpixel 315B. Primary color subpixels 315R, 315G and 315B can have various shapes and they can be arranged in various ways with respect to each other. By way of example, FIG. 11 illustrates that primary color subpixels 315R, 315G and 315B have three surfaces arranged in parallel and one surface connecting three surfaces. The distance among three surfaces for each primary color subpixel may be different and each surface of each primary color subpixel may have a different length. FIG. 11 also illustrates that primary color subpixels 315R, 315G and 315B are arranged such that the parallel surfaces of the primary color subpixels are alternatively arranged. FIG. 12 illustrates that a second pixel 325 includes nine white subpixels 325W arranged in a 3 by 3 matrix. FIG. 12 illustrates that each of primary color subpixels 315R, 315G and 315B overlaps at least partially with each of white subpixels 325W.

In one embodiment, each of primary color subpixels 315R, 315G and 315B can be configured to have portions disposed to be overlapped with each of nine white subpixels 325W. Accordingly, portions of all of three primary color subpixels 315R, 315G and 315B can be disposed under (or over) each of white subpixels 325W. Accordingly, nine pixels PX, which are arranged in a matrix shape of 3 by 3, can be formed.

The shapes of primary color subpixels 315R, 315G and 315B can be varied as long as it is satisfied that each of primary color subpixels 315R, 315G and 315B can overlap at least partially with each of white subpixels 325W. In another embodiment, one or two of primary color subpixels shown in FIG. 11 may be configured to rotate with respect to the other primary color subpixels. By way of example, red subpixel 315R may be rotated in clockwise or counterclockwise direction, by, for example, 90 degrees (or 180 or 270 degrees) with respect to green subpixel 315G and/or blue subpixel 315B, such that at least a portion of red subpixel 315R can be overlapped with each of white subpixels 325W. In still another embodiment, primary color subpixels 315R, 315G and 315B may have three surfaces arranged in parallel and two surfaces respectively connecting right ends of upper two surfaces and left ends of lower two surfaces. At a region where primary color subpixels cross, primary color subpixels may be formed at vertically different layers by being vertically curved so as not to contact each other.

Although it is illustrated that first display panel 110 includes primary color subpixels and second display panel 120 includes white subpixels, it is apparent to those skilled in the art that first display panel may include white subpixels and second display panel may include primary color subpixels. In one embodiment where the first display panel is a PDP including white subpixels, white subpixels of the PDP may be formed by forming white phosphor. In another embodiment where the first display panel is an LCD panel or an OLED panel including white subpixels, the white subpixels of the LCD panel or the OLED panel may be formed by forming transparent color filters with a photoresist (PR) without pigments. In such cases, the second display panel may be an LCD panel including primary color subpixels, and the primary color subpixels of the LCD panel may be formed by forming color (R, G, and B) filters with a color (R, G, or B) PR including color (R, G, or B) pigment.

The herein described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

The invention claimed is:

1. A display device comprising:

a first display panel configured to generate a first image; and a second display panel disposed on the first display panel and configured to generate a second image using light from the first display panel, wherein:

one of the first display panel and the second display panel includes monochrome pixels, each monochrome pixel including a plurality of monochrome subpixels, the other of the first display panel and the second display panel includes color pixels, each color pixel including primary subpixels, and for a first monochrome pixel and a second color pixel, the primary subpixels of the second color pixel are arranged to each overlap with more than one of the monochrome subpixels in the first monochrome pixel, and each of the monochrome subpixels corresponds to a portion of more than one of the primary subpixels, wherein a shape of each primary subpixel is different from a shape of each monochrome subpixel.

2. The display device of claim 1, wherein the first display panel is a self-emissive display panel and the second display panel is a non-emissive display panel.

3. The display device of claim 2, wherein the first display panel includes a plasma display panel (PDP), an organic light emitting display (OLED) panel, a field emission display (FED) panel, a cathode ray tube (CRT) panel, or a vacuum fluorescent display (VFD) panel.

4. The display device of claim 2, wherein the second display panel includes a liquid crystal display (LCD) panel.

5. The display device of claim 1, wherein both the first display panel and the second display panel are a liquid crystal display (LCD) panel and the first display panel includes a backlight unit disposed under the LCD panel.

6. The display device of claim 1, wherein portions of the primary subpixels of the second color pixel and the respective monochrome subpixels are overlapped each other to form a plurality of unit pixels.

7. The display device of claim 1, wherein the monochrome subpixels are arranged in a 2 by 2 matrix shape, and each of the primary subpixels is configured to overlap at least partially with all of the monochrome subpixels.

8. The display device of claim 1, wherein the monochrome subpixels are arranged in a 3 by 3 matrix shape, and each of the primary subpixels is configured to overlap at least partially with all of the monochrome subpixels.

9. The display device of claim 1, wherein portions of the primary subpixels of the second color pixel and the respective monochrome subpixels are overlapped with each other to form a plurality of unit pixels.

10. The display device of claim 9, wherein a brightness of each unit pixel can be controlled independently.

11. A display device comprising:

a first display panel configured to generate a first image, the first display panel including first pixels, each first pixel having primary subpixels; and a second display panel disposed on the first display panel and configured to generate a second image, the second display panel including second pixels, each second pixel having white subpixels, wherein each second pixel is arranged relative to a corresponding first pixel to form unit pixels, wherein each first pixel includes more than one unit pixel and each unit pixel includes one of the white subpixels and a portion of each of the primary subpixels such that the primary subpixels of the first pixel are arranged to each overlap with more than one of the white subpixels in the second pixel and such that each of the white subpixels corresponds to a portion of more than one of the primary subpixels in each first pixel, and wherein a shape of each of the primary subpixels is different from a shape of each of the white subpixels.

12. The display device of claim 11, wherein a brightness of each unit pixel can be controlled separately from other unit pixels.

13. A display device comprising:

a first display panel configured to generate a first image, the first display panel including first pixels, each first pixel having primary subpixels; and a second display panel disposed on the first display panel and configured to generate a second image, the second display panel including second pixels, each second pixel having white subpixels, wherein the each second pixel is arranged relative to a corresponding first pixel such that a brightness of different portions of each first pixel can be controlled independently of other portions of each first pixel, wherein the primary subpixels of the first pixel are arranged to each overlap with more than one of the white subpixels in the second pixel, wherein each of the white subpixels corresponds to a portion of more than one of the primary subpixels, and wherein a shape of the primary subpixels is different from a shape of the white subpixels.

14. The display device of claim 13, wherein each white subpixel is arranged to overlap a different portion of each of the primary subpixels.

* * * * *

UNITED STATES PATENT AND TRADEMARK OFFICE

CERTIFICATE OF CORRECTION

PATENT NO. : 8,487,835 B2
APPLICATION NO. : 12/767924
DATED : July 16, 2013
INVENTOR(S) : Jung It is certified that error appears in the above-identified patent and that said Letters Patent is hereby corrected as shown below:

On the Title Page, item (56), under "OTHER PUBLICATIONS", in Column 2, Line 3, delete "et al" and insert -- et al., --, therefor.

In the Specification

In Column 2, Line 57, delete "110 120" and insert -- 110 and 120 --, therefor.

Signed and Sealed this
Twelfth Day of November, 2013

Teresa Stanek Rea

Teresa Stanek Rea
*Deputy Director of the United States Patent and Trademark Office*